US005315733A

United States Patent [19]

Ledingham

[11] Patent Number: 5,315,733

[45] Date of Patent: May 31, 1994

[54] PAINT BRUSH BRISTLE CLAMP

[76] Inventor: Blake A. Ledingham, 501 - 1200 West Pender Street, Vancouver, B.C., Canada, V6E 2S9

[21] Appl. No.: 968,659

[22] Filed: Oct. 30, 1992

[51] Int. Cl.[5] ..... A46B 9/08

[52] U.S. Cl. ..... 15/168; 24/543; 24/563

[58] Field of Search ..... 15/168, 169; 24/67.9, 24/507, 543, 563

[56] References Cited

U.S. PATENT DOCUMENTS

| | | | |
|---|---|---|---|
| 1,238,720 | 8/1917 | Wall | 24/543 X |
| 1,388,224 | 8/1921 | Ward | 15/169 |
| 2,874,399 | 2/1959 | Friedman | 15/169 |
| 3,866,276 | 2/1975 | Perkins | 24/543 |
| 4,062,084 | 12/1977 | DuBois | 15/169 |
| 4,129,918 | 12/1978 | Lee | 15/169 |
| 4,237,579 | 12/1980 | Salmon | 15/166 |
| 4,339,837 | 7/1982 | Reeberg | 15/169 |
| 4,754,534 | 7/1988 | Helwick | 24/543 |

FOREIGN PATENT DOCUMENTS

| | | | |
|---|---|---|---|
| 497801 | 12/1950 | Belgium . | |
| 236369 | 7/1925 | United Kingdom | 15/169 |
| 273600 | 7/1927 | United Kingdom | 15/168 |
| 501059 | 2/1939 | United Kingdom | 24/543 |

*Primary Examiner*—Harvey C. Hornsby
*Assistant Examiner*—Mark Spisich
*Attorney, Agent, or Firm*—Barrigar & Oyen

[57] ABSTRACT

This invention pertains to a paint brush bristle clamp which can be removed after paint brush use, and facilitates cleaning of paint from the brush. A removable paint brush bristle clamp comprising: (a) a pair of opposed end walls; (b) a first side wall located between the pair of end walls and joined thereto; (c) a second side wall opposed to the first side wall, the second side wall being joined at one end to one of the end walls, the opposite end of the second side wall being free and having a first lip formed thereon; (d) a second lip formed on one end of one of the end walls, adjacent to the lip formed on one edge of the adjacent side wall, said second lip being adapted to mate with the first lip on the side wall to thereby provide an opening and closing action.

1 Claim, 2 Drawing Sheets

PAINT BRUSH BRISTLE CLAMP

FIELD OF THE INVENTION

This invention pertains to a paint brush bristle clamp which can be removed after paint brush use, and facilitates cleaning of paint from the brush.

BACKGROUND OF THE INVENTION

A longstanding problem with paint brushes that are used for industrial and domestic painting applications is that with time and repeated use paint tends to build up within the bristles in the region where the bristles are held by the clamp that joins the bristles with the paint brush handle and base. The collected paint is difficult to clean away. Usually, some residual paint is left in the bristles even after the used brush has been cleaned. The dried paint collects and builds up over time with repeated use of the paint brush. This causes the bristles of the brush to spread and reduces the efficiency of the brush. Also, the dried paint build up tends to cause the bristles to wear and break at the location of the dried paint. This reduces the life of the paint brush.

Proper cleaning of a paint brush requires a considerable amount of solvent, if the person cleaning the brush is meticulous. This often represents a waste of costly solvent, and creates an environmental pollutant. Thus, most commercial painters will endeavour to minimize costs by balancing the amount of the solvent used with the number of times the paint brush is used. It may be economic, for instance, to expect a paint brush to be used a half-dozen times before it must be discarded, rather than waste a considerable amount of solvent attempting to meticulously clean the brush after each use and prolong the life of the brush.

It would be advantageous if some means could be developed which would minimize or eliminate the build up of paint in the location where the bristles are set or meet the paint brush handle. It would also be advantageous if a mechanism could be developed to reduce the amount of solvent which is required to clean a paint brush. It would also be useful if a mechanism could be developed which would reduce or eliminate bristle flare as it occurs over time when a paint brush is used a number of times.

U.S. Pat. No. 4,129,918, granted Dec. 19, 1978, to Robert Lee, disclosed an adjustable sleeve for an artist's paint brush adapted to adjust the effective length of the bristles of the brush. The adjustable sleeve is tubular at its tip to contain the hair or bristles. The sleeve is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles. The sleeve is designed for use with an artist's brush, which has bristles arranged in a taper column form. The sleeve does not fit over the base of the brush at the location where the bristles meet the base.

U.S. Pat. No. 4,237,579, issued Dec. 9, 1980, to Johnathan H. Salmon, discloses a tool for applying a liquid stain to a flat surface to impart a timber grain effect to the surface. The tool comprises a paint brush, a bristle retaining slidable plate on one side of the brush and a slidable comb plate on the other side of the brush. Both of the plates have an elongated slot which engages a bolt which passes through the paint brush. The comb adjustably separates the brush bristles into discrete bunches to permit the application of stain to impart a wood grain pattern to the surface. This tool does not disclose a holder which fits on both sides of the paint brush base where the bristles are secured to the base. The tool is not designed to prevent paint from migrating down the bristles in the direction of the base.

U.S. Pat. No. 4,339,837, granted Jul. 20, 1982, to Christiaan Reeberg, discloses a sliding box-like girdle which can be fit over a paint brush to confine the bristles. The girdle acts as a hanger so that the paint brush can be hung on a wall. The girdle also protects the brush bristles while on display, or during storage. Further, the girdle is used to control the effective length of the bristle ends for specific painting jobs. The girdle also serves to squeeze excess paint from the bristles after each dip into a can of paint. The girdle does not serve to encircle the base of the paint brush, where the bristles meet the paint base, and thereby prevent paint from migrating along the bristles to the base, and thereby collecting at the base-bristle ended face.

SUMMARY OF THE INVENTION

The invention is directed to a removable paint brush bristle clamp comprising: (a) a pair of opposed end walls; (b) a first side wall located between the pair of end walls and joined thereto; (c) a second side wall opposed to the first side wall, the second side wall being joined at one end to one of the end walls, the opposite end of the second side wall being free and having a first lip formed thereon; (d) a second lip formed on one end of one of the end walls, adjacent to the lip formed on one edge of the adjacent side wall, said second lip being adapted to mate with the first lip on the side wall to thereby provide an opening and closing action.

At least one reinforcing rib of the clamp can be formed on the interior side of one of the side walls. The adjoining corners between the adjoining end walls and side walls can be hinged. The corners can be constructed of resilient material.

The invention is also directed to a paint brush combination comprising: (a) a handle with a base; (b) a ferrule encircling the base and extending beyond the base to provide an open-ended enclosure; (c) a bundle of bristles secured within the enclosure formed by the extended end of the ferrule, and being bonded to the base inside the ferrule; (d) an elongated plug disposed within the ferrule and the bristle bundle, and separating the bristles into two groups, the plug extending beyond the end of the ferrule; (e) a removable clamp adapted to be fitted about one end of the ferrule and the bristles, so as to overlap the extended portion of the plug.

The clamp can be formed of a resilient spring-like material, and can be opened or closed at one part thereof to enable the clamp to be affixed to or removed from the ferrule and bristles.

The plug can be formed of rigid material, foam-like material, or cardboard.

The clamp can be formed of polyethylene or polypropylene and can have at least one reinforcing rib. The clamp can have formed therein an opening, with mating lips formed in adjoining edges of the opening, said lips being adapted to removably clamp together to enable the clamp to be secured about the ferrule and bristles.

The clamp can be formed of spring steel and can have hinged corners which have a spring action.

BRIEF DESCRIPTION OF THE DRAWINGS

In drawings which illustrate specific embodiments of the invention but which should not be construed as restricting the spirit or scope of the invention in any way.

DETAILED DESCRIPTION OF SPECIFIC EMBODIMENTS OF THE INVENTION

Figure 1:
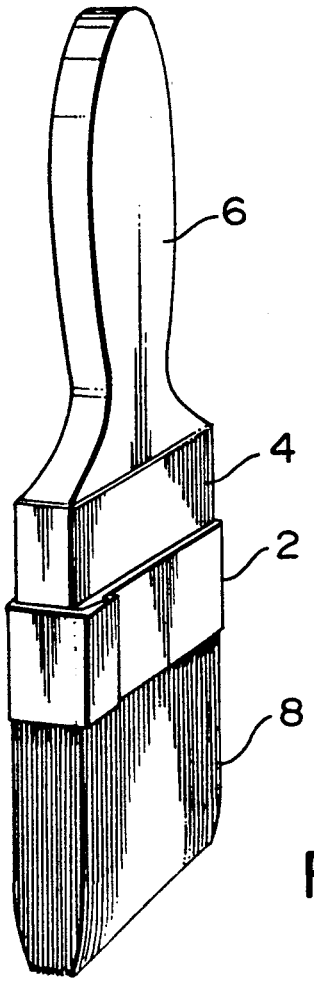
FIG. 1 illustrates an isometric view of a paint brush with the paint brush bristle clamp thereon.

Referring to the drawings, FIG. 1 illustates an isometric view of a conventional paint brush with the bristle clamp 2 in place over the ferrule and paint brush bristles. Specifically, the bristle clamp 2 is clamped in place over at least the bottom end of the ferrule 4 and the top ends of the bristles 8. The ferrule 4 is typically made of metal and fits around the base of the handle 6, and assists in holding the top ends of the bristles 8 in place. In the manufacture of a conventional paint brush, the ferrule 4 is enclosed around the base of the handle 6 to provide an enclosure with an open end, and the base of the bunch of bristles is fitted into the open end of the clamped ferrule 4. The base is then glued in place by some typical thermosetting resin such as an epoxy resin. While not seen in FIG. 1, the base of the bristles (under the clamp 2 and the ferrule 4) is typically divided into two parts by a cardboard plug (see FIG. 4) which fits within 6 the ferrule 4 and extends from the base end of the handle to approximately the lower end of the ferrule 4. The purported purpose of the cardboard plug is to provide an opening in the interior of the bristles into which paint can be loaded, thereby enabling the brush to hold more paint, and thereby minimize the times the brush must be dipped in the paint.

Figure 2:
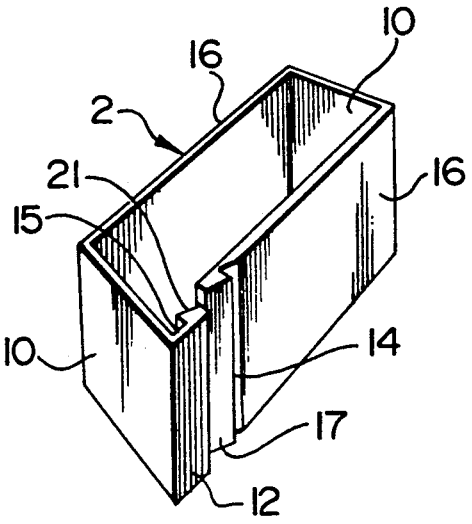
FIG. 2 illustrates an isometric view of the paint brush bristle clamp in opened position.

FIG. 2 illustrates an isometric view of the paint brish bristle clamp 2 in open configuration. The clamp 2 is constructed of a pair side walls 16, and a pair of end walls 10, which are joined together at three corners. At the fourth corner, the side wall 16 and the end wall 10 are not joined and can be opened as illustrated in FIG. 2. The joint can be closed by having lip 12 moved into place over lip 14 on wall 16. Lip 12 has a groove 15 formed therein for receiving an inclined surface portion 17 of lip 14. Similarly, side wall 16 has a recess 19 formed therein for receiving an inclined surface portion 21 of lip 12 (best seen in FIG. 3). Lip 14 is a first projection extending laterally outward from side wall 16 and lip 12 is a second projection extending inwardly towards the opposite side wall so that the inclined surface portion 17 of the first projection matchingly fits inside groove 15 and the inclined surface portion 21 of the second projection matchingly fits inside recess 19 when the clamp is in a closed position. The clamp 2 is typically formed of a resilient spring-like material, such as polyethylene or polypropylene, which prefers to return to a closed position when it has been opened.

Figure 3:
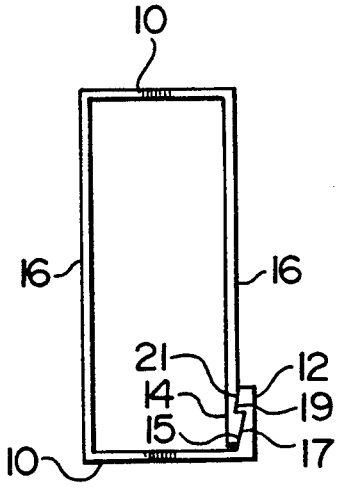
FIG. 3 illustrates a top view of the paint brush bristle clamp in closed position.

FIG. 3 illustrates a top view of the clamp 2. As seen in FIG. 3, the clamp 2 is in a closed position, by having lip 12 engage with lip 14. Since the clamp 2 is formed of a spring-like material, the closed position is preferred.

Figure 4:
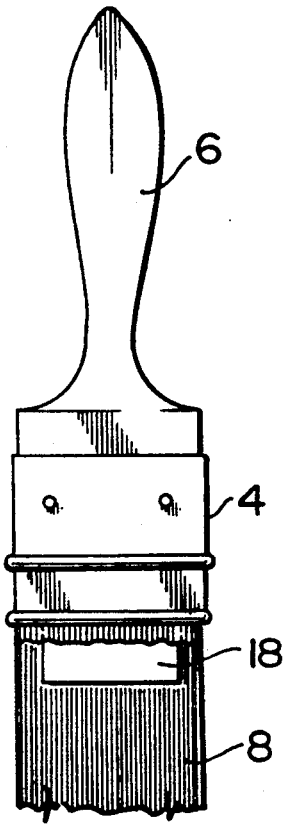
FIG. 4 illustrates a front partial section view of a paint brush with an extended plug.

FIG. 4 illustrates a front partial section view of a paint brush with extended plug. The paint brush with the extended cardboard plug 18 is adapted for use in combination with the bristle clamp 2. As seen in FIG. 4, the plug 18 (which is typically formed of cardboard) extends a certain distance below the end of ferrule 4. The extended portion of the plug 18 provides a foundation against which the clamp 2, when it is clamped in place over the ferrule 4 and bristles 8, can exert a compressive force on the bristles 8.

Figure 5:
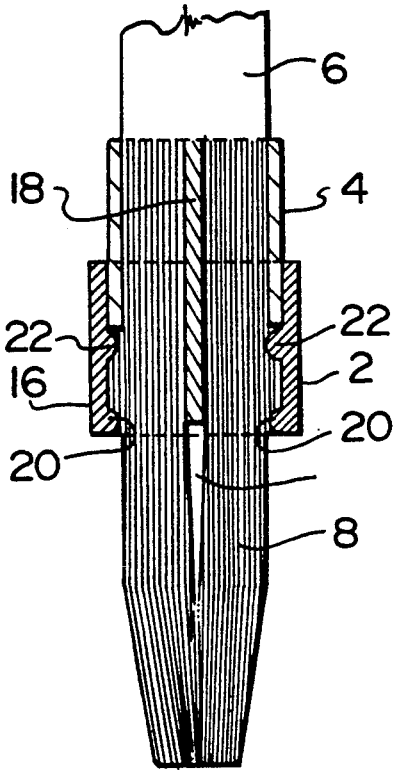
FIG. 5 illustrates an end partial section view of a paint brush with an extended plug, and the bristle clamp in place over the ferrule, plug and bristles.

FIG. 5 illustrates a partial section end view of the paint brush with the clamp 2 in place over the base of the ferrule 4, and over the top region of the bristles 8. The extended plug 18 is also visible. As can be seen in FIG. 5, the clamp 2, when closed, exerts an inward compressive force on the top ends of the bristles 8. This force tends to inhibit the migration of paint particles from the lower free end of the bristles 8 upwardly to the top region of the bristles 8. Conventional paint is an emulsion of a liquid solvent carrier and suspended solid paint particles. The force of the clamp may cause migration and evaporation of the solvent carrier to exceed that of the solid particles. This effect compounds itself at the point of pressure as time goes on. While the solvent in the paint may travel up the bristles 8 by means of capillary action, the solid paint particles per se are prevented from migrating up the bristles 8 by the force exerted between the clamp 2 against plug 18. Since the plug 18 is extended beyond the end of the ferrule 4, it still provides a cavity 24, as with conventional paint brushes, in which paint can be loaded in order to enable the paint brush to be used for longer periods of time between paint can dippings.

Since it is desirable to exert as much compressive force against the tops of bristles 8 as possible, it is advantageous to enhance the dimensional stability of clamp 2 by reinforcing the sidewalls 16 by means of reinforcing ribs 20 and 22. By clamping the tops of the bristles 8 closely together, between the ribs 20 and 22, and the plug 18, the spaces between the bristles 8 are very small, and only the solvent in the paint can migrate upwardly through those spaces by capillary action. The paint particles are effectively stopped at the edge of lower ribs 20. Then, after the paint brush has been used and is ready for cleaning, and clamp 2 is removed, the paint particles have collected on an exposed region of the bristles 8 where the paint particles can be readily rinsed away with a cleaning solvent. Less solvent can be used since the paint particles are readily exposed, and can be separated from the bristles by flexing the bristles 8, which are no longer retained by the clamp 2.

Figure 6:
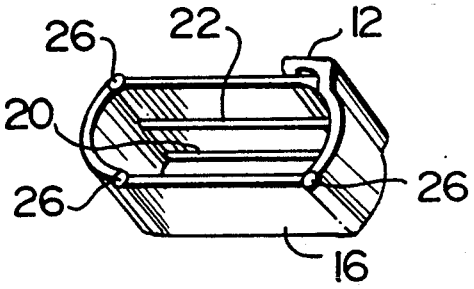
FIG. 6 illustrate an isometric view of a modified embodiment of the paint brush bristle clamp.

FIG. 6 illustrates an isometric view of an alternative embodiment of clamp 2. Hinges 26 are located at the three corners removed from the corner clamp opening. The hinges 26 can be spring loaded (not shown) or formed in the clamp corners. The reinforcing ribs 20 and 22 are visible in FIG. 6. The clamp configuration illustrated in FIG. 6 can be formed of metal with spring loaded hinges, or injection molded polyethylene or polypropylene (high density). These plastics have inherent spring-like qualities, are reasonably rigid, and can be flexed countless times without breaking.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paint brush bristle clamp comprising:

a pair of opposed end walls;

a first and second side walls, the first side wall having two ends attached to different end walls and the second side wall having one end attached to one of the end walls and having a free end so that the end walls and side walls form a substantially rectangular clamp;

said free end of the second side wall having a free end lip formed thereon, the lip comprising an inclined surface portion and a recess formed on the second side wall;

an end wall lip formed on one end of the end wall opposed to the end wall attached to the second side wall, said end wall lip having an inclined surface portion and a groove formed therein so that the inclined surface portion of the free end lip matchingly fits inside the groove and the inclined surface portion of the end wall lip matchingly fits inside the recess when the clamp is in a closed position.

* * * * *